US008793826B2

(12) United States Patent
Nurminen

(10) Patent No.: US 8,793,826 B2
(45) Date of Patent: Aug. 5, 2014

(54) SURGICAL OPERATING TABLE

(75) Inventor: Ari Nurminen, Lahti (FI)

(73) Assignee: Merivaara Oy, Lahti (FI)

( * ) Notice: Subject to any disclaimer, the term of this patent is extended or adjusted under 35 U.S.C. 154(b) by 300 days.

(21) Appl. No.: 13/297,969

(22) Filed: Nov. 16, 2011

(65) Prior Publication Data

US 2012/0210514 A1 Aug. 23, 2012

(30) Foreign Application Priority Data

Nov. 16, 2010 (FI) ..... 20106206

(51) Int. Cl.
*A61G 13/12* (2006.01)
*A61G 13/00* (2006.01)

(52) U.S. Cl.
CPC ..... *A61G 13/1255* (2013.01); *A61G 2200/54* (2013.01); *A61G 2013/0072* (2013.01); *A61G 13/1285* (2013.01)
USPC ..... 5/617; 5/630

(58) Field of Classification Search
CPC ... A61G 7/015; A61G 13/08; A61G 13/1255; A61G 2013/0072; A61G 13/1285; A61G 2200/54
USPC ..... 5/613, 617, 618, 620, 723, 657, 623, 5/630, 646
See application file for complete search history.

(56) References Cited

U.S. PATENT DOCUMENTS

| | | | | |
|---|---|---|---|---|
| 5,275,176 | A | 1/1994 | Chandler | |
| 5,926,876 | A | 7/1999 | Haigh | |
| 6,557,196 | B2 * | 5/2003 | Falbo et al. | 5/601 |
| 6,564,406 | B2 | 5/2003 | Vansteenburg | |
| 2001/0032364 | A1 | 10/2001 | VanSteenburg et al. | |
| 2004/0226092 | A1 | 11/2004 | Goodwin | |

* cited by examiner

*Primary Examiner* — Nicholas Polito
(74) *Attorney, Agent, or Firm* — Patterson Thuente Pedersen, P.A.

(57) ABSTRACT

A surgical operating table has a plurality of sections, connected to each other and capable of being pivoted at least in vertical plane, and upon which the patient is rested while a surgical procedure is performed. These sections include a back support, which comprises a lower back section, a middle back section protruding therefrom, and two shoulder sections disposed on either side of the middle back section and releasably secured to the lower back section. In the releasing process, the shoulder section is first pivoted to an inclined angle downward from a plane of the lower back section and the middle back section, thus enabling a protrusion on the shoulder section to be released from a clamping of the frame portion and the rod, on the lower back section after which the shoulder section is capable of being pulled away and removed from the lower back section.

11 Claims, 6 Drawing Sheets

SURGICAL OPERATING TABLE

The invention relates to a surgical operating table in particular, to a surgical operating table for use in shoulder surgery.

BACKGROUND OF THE INVENTION

Prior known from U.S. Pat. No. 5,275,176 is a surgical operating table, which is particularly intended for shoulder operations. The surgical operating table comprises a platform for the patient. The platform has a plurality of portions capable of being pivoted relative to each other, including a back support with two shoulder cut-out modules in connection therewith. The shoulder cut-out modules are releasably secured to the back portion by means of two straight support rods, said rods extending downwardly from the shoulder cut-out module and being inserted in a securing process into straight guide sleeves of the back support. The shoulder cut-out module is locked in place (and respectively unlocked) with a tightening knob in engagement with the sleeve.

A problem with the above-described surgical table is a shoulder cut-out module securing mechanism; the shoulder cut-out modules are removed by pulling the same out of the back support in the same plane therewith. With a patient present on the surgical operating table, his/her shoulder is resting against the shoulder cut-out module, whereby procedures related to the shoulder cut-out module must be conducted with caution and there is nonetheless a risk of touching and moving the shoulder, which is not desirable from the standpoint of a patient and a surgical procedure. Hence, patient safety is not at high level.

Another drawback is that the support rods of a shoulder cut-out module must be relatively lengthy in order to achieve reliable attachment. Accordingly, the removal and insertion process of a shoulder cut-out module involves a long motion distance, making the procedure inconvenient to perform and claiming a lot of space.

A problem is also presented by the fact that releasing and reinserting a shoulder cut-out module obviously requires the work input of two attendants in order to perform the procedure safely.

SUMMARY OF THE INVENTION

An object of particular embodiments of the invention, among others, is to eliminate the problems related to the above-described surgical operating table. Another object of particular embodiments of the invention is to provide a new improved surgical operating table, wherein a shoulder module is removable and insertable readily and safely.

Embodiments of the invention relate to a surgical operating table, which is intended for shoulder operations or surgical procedures performed on a similar or close part of the body, the surgical table comprising a platform for the patient and an adjustment pedestal portion with the platform rested thereupon, and said platform preferably having a plurality of sections, which are connected to each other and capable of being pivoted at least in vertical plane (horizontal axis), and upon which the patient is rested while a surgical procedure is performed, said sections including a back support, which comprises a lower back section, a middle back section protruding therefrom, and two shoulder sections disposed on either side of the middle back section and releasably secured to the lower back section by means of attachment elements. According to embodiments of the invention, the attachment elements comprise first and second attachment elements, such that, for example:

the shoulder section is provided with first attachment elements, which comprise an inclined protrusion and, in engagement therewith, a groove which is disposed at an end of the shoulder section, the lower back section, particularly sides of the lower back section, are provided with second attachment elements comprising a frame portion, a rod, and a gap therebetween, wherein, in a securing process of the shoulder section, the inclined protrusion of the first attachment elements is pushed into the gap while the shoulder section is at an inclined angle relative to the lower back section's plane in such a way that the rod finds the gutter, groove or slot of the protrusion and is supported therein, which is followed by pivoting the shoulder section from the inclined angle to a position coplanar with the lower back section and the middle back section with the rod constituting a pivoting axis, whereby the protrusion is wedged and clamped between the frame portion and the rod and maintains the shoulder panel locked to the side of the lower back section, and wherein, in its releasing process, the shoulder section is first pivoted to an inclined angle downward from a plane of the lower back section and the middle back section, thus enabling the protrusion to be released from the clamping of the frame portion and the rod, after which the shoulder section is capable of being pulled out of the gap and removed from the lower back section.

In embodiments of the invention, the protrusion may be a conical or tapered member, which is at an angle relative to a longitudinal direction and vertical plane of the shoulder section and tapering towards a tip. The resulting advantage is that the shoulder section provided with such a conical protrusion can be conveniently fitted in a gap between a frame element and a rod. A further benefit is that the shoulder section provided with such a protrusion clamps firmly and reliably in place in the above-mentioned gap. In a second preferred embodiment of the invention, the rod of the second attachment elements has its end provided with a flange and the flange has its edge closer to the rod provided with a chamfer, which is adapted to function as a guide means for the protrusion as the shoulder section's protrusion is inserted into the gap in a securing process of the shoulder section. A resulting benefit is that the flange and its chamfer facilitate significantly the fitting of a shoulder section in engagement with a lower back section.

In a third embodiment of the invention, the shoulder section is further provided with a locking device for a removable attachment of the shoulder section to the middle back section, said locking device being arranged in connection with a first side of the shoulder section and that side of the middle back section which is closer to the shoulder section. A resulting advantage is that the attachment and secure locking of the shoulder section is thereby achieved in a simple and effective manner.

Another advantage of the invention is that the shoulder section is by one hand releasable from and reinsertable into engagement with a surgical table. Manipulation of the shoulder section is quick and simple.

DETAILED DESCRIPTION

Figure 1:
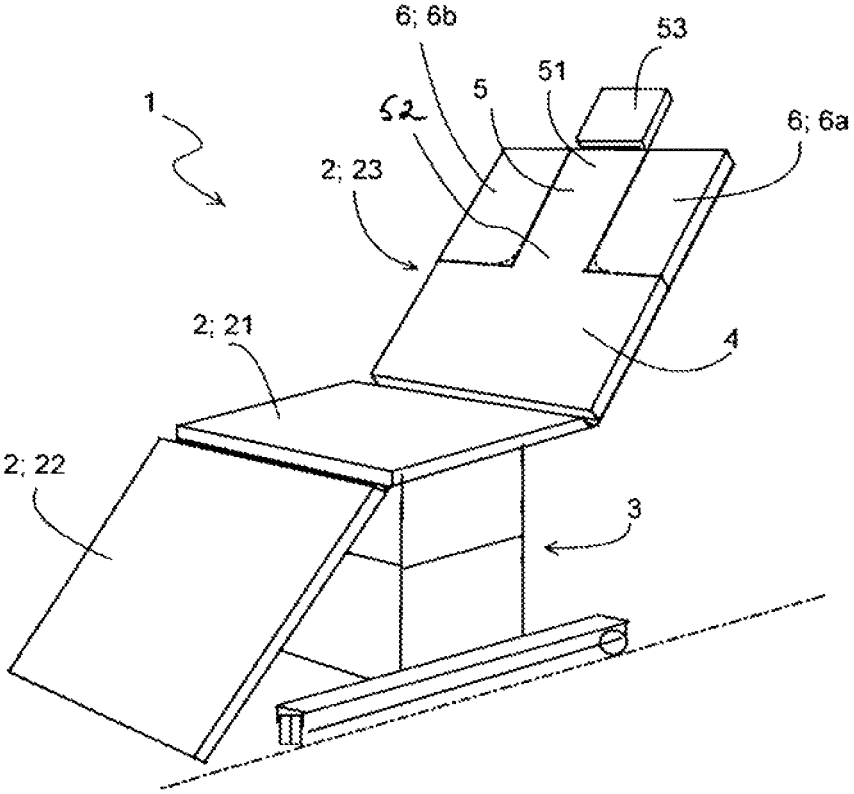
FIG. 1 shows a surgical operating table of an embodiment of the invention in a view obliquely from above.
Figure 2:
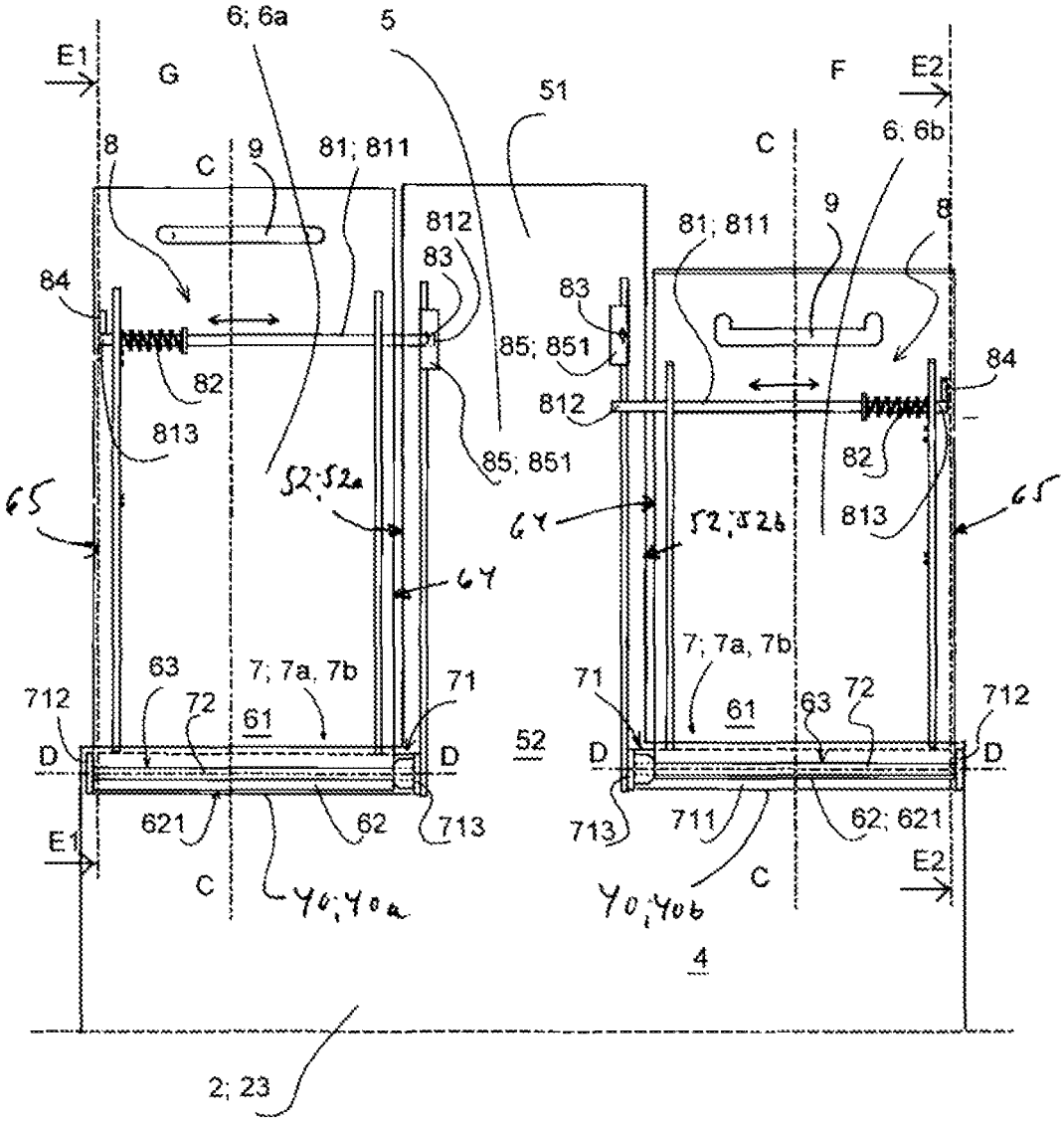
FIG. 2 shows a surgical operating table of an embodiment of the invention, especially its back section, in a view from behind.
Figure 3A:
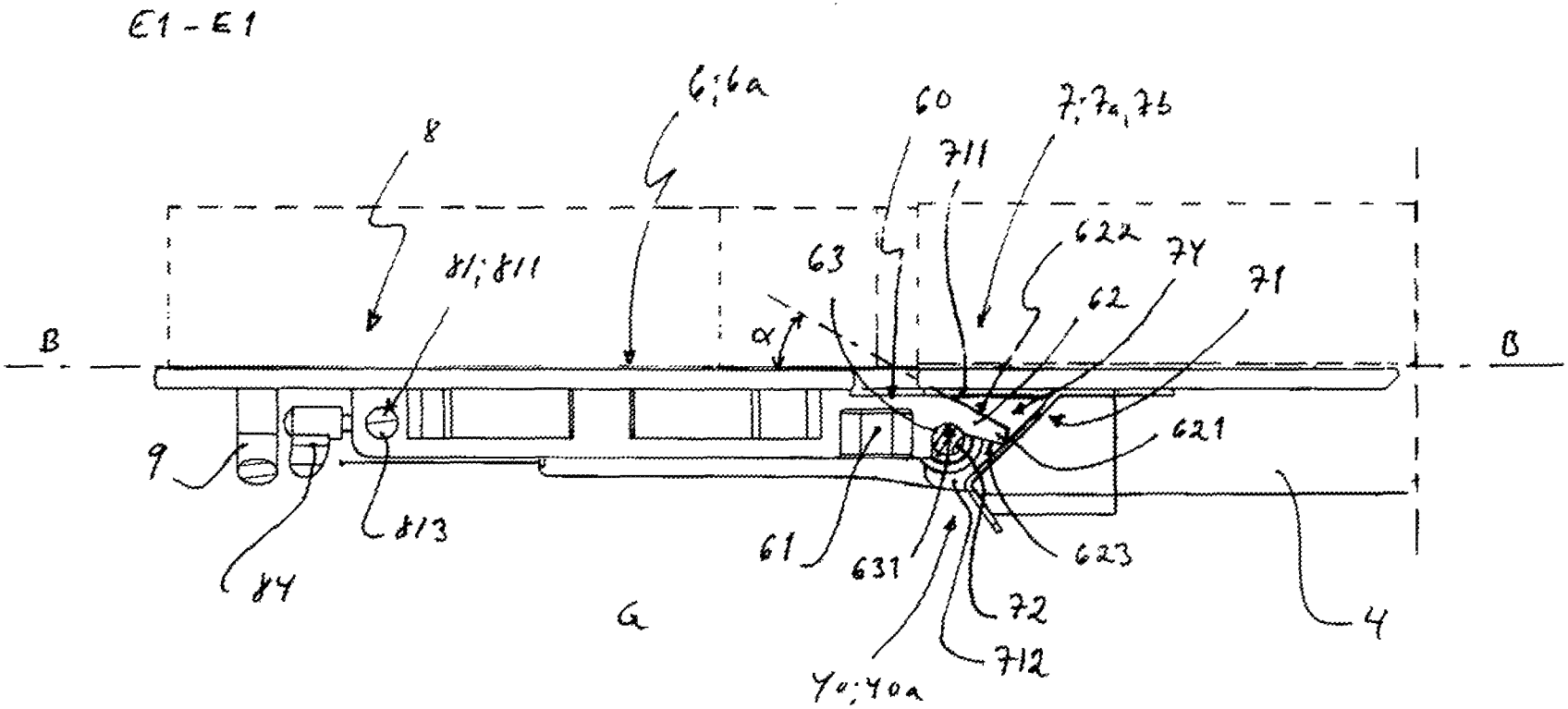
FIG. 3A shows a section E1-E1 of the surgical operating table of FIG. 2, especially of a shoulder section which is in line with the back support's plane, i.e. in a linear position G.
Figure 3B:
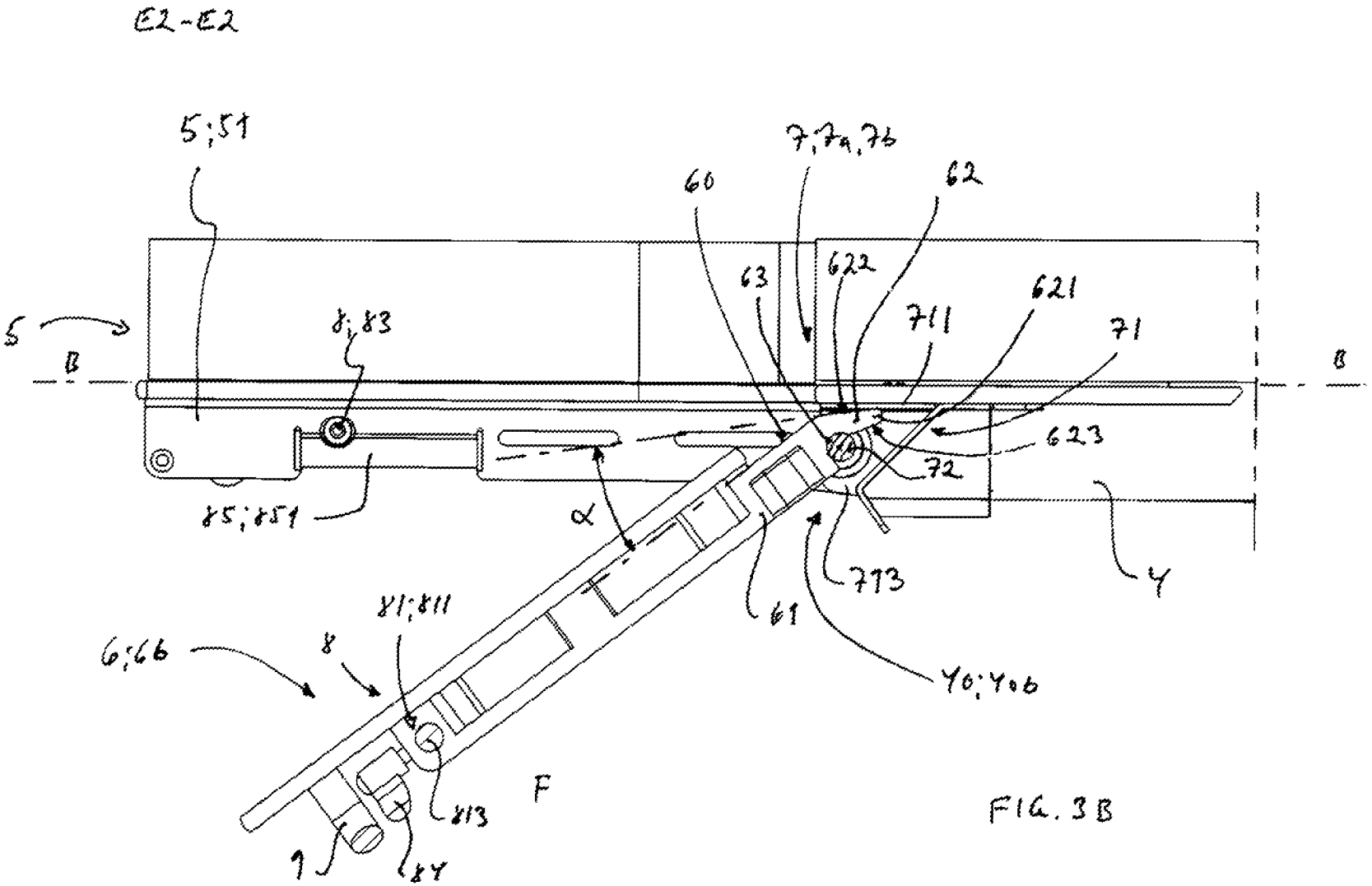
FIG. 3B shows a section E2-E2 of the surgical operating table of FIG. 2, especially of a shoulder section which is at an inclined angle relative to the back support's plane, i.e. in an inclined position F.
Figure 4A:
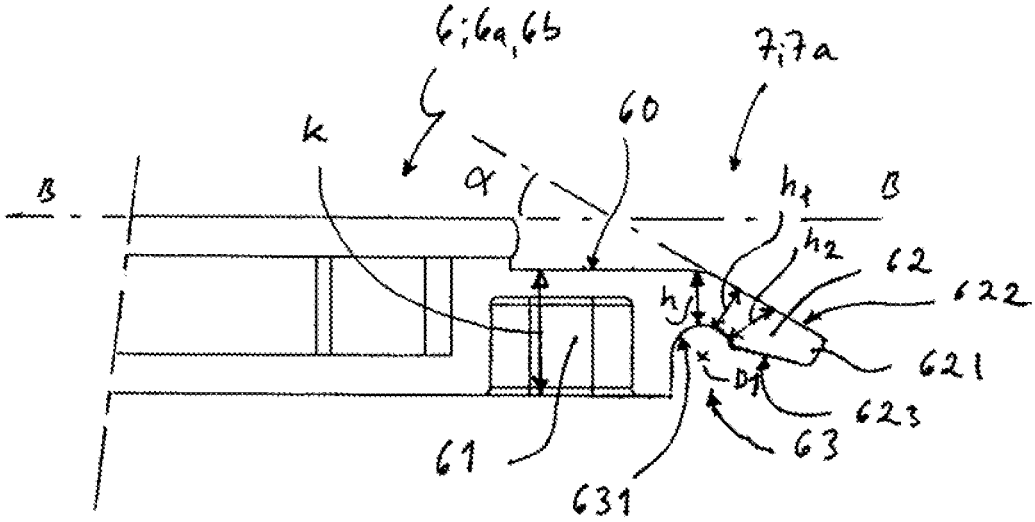
FIG. 4A shows an enlarged detail of a first end of the shoulder section and first attachment means in a section view.
Figure 4B:
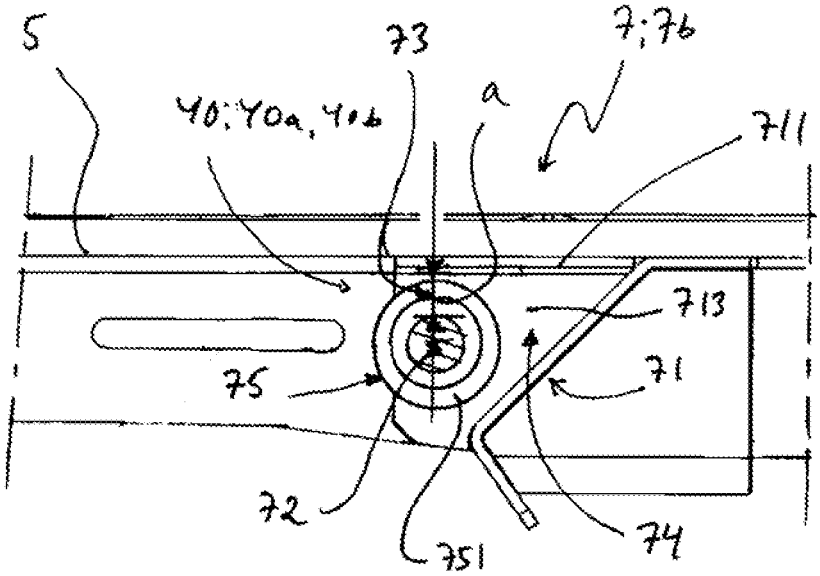
FIG. 4B shows an enlarged detail of a side of the back support, especially the lower back section, and second attachment means in a section view.
Figure 5:
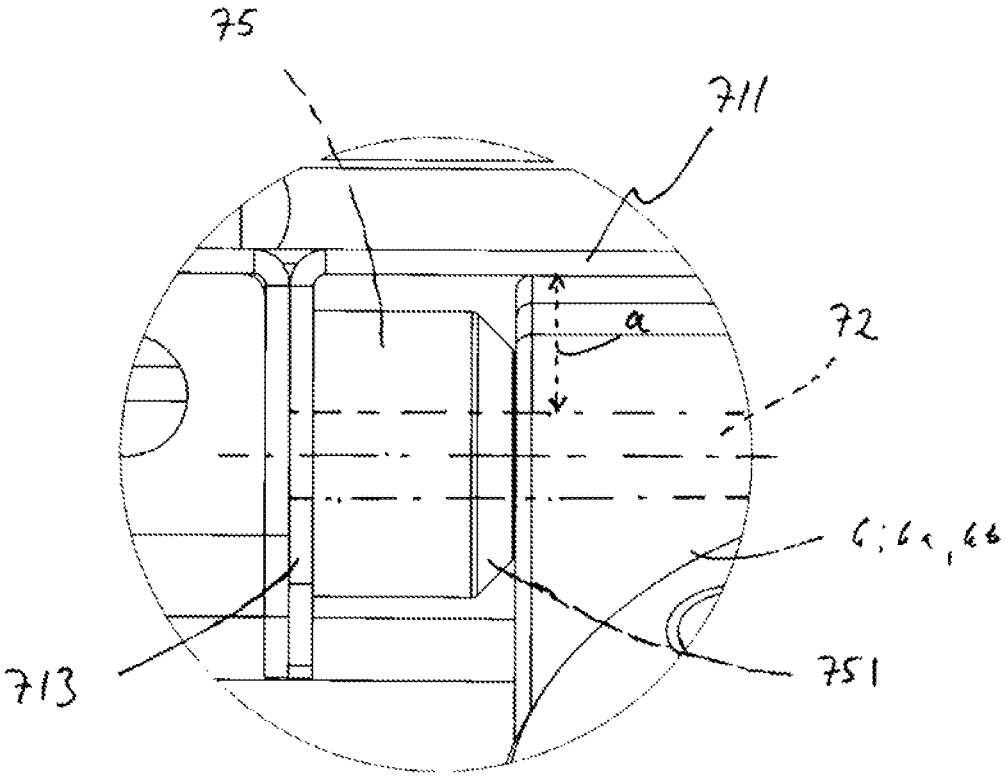
FIG. 5 shows an enlarged detail of the attachment means, especially a rod of the first attachment means.

Referring to the figures, a surgical operating table 1 is intended for shoulder operations or surgical procedures performed in a similar part of the body. The surgical operating table 1 comprises a platform 2 for the patient and an adjustment pedestal portion 3, upon which the platform 2 is rested. The surgical operation table 1 has its platform 2 preferably comprised of a plurality of elements, which are connected to each other and capable of being pivoted at least in vertical plane and provided with a most preferably elastic padding, the patient being positioned in support thereof as a surgical operation is performed. The platform 2 includes sections such as, among others, a pelvis support 21, a leg support 22, and a back support 23.

The pelvis support 21 provides support for the patient mainly in mid-body and pelvic regions, the leg support 22 for the patient's legs, and the back support 23 for the patient's torso. The adjustment pedestal portion 3 comprises elements for adjusting a height of the platform 2 and relative positions of the platform sections 21, 22, 23. The platform's 2 sections 21, 22, 23 are adjustable e.g. to a horizontal plane and to angular positions relative to each other e.g. in a lengthwise vertical plane of the platform.

The surgical operating table's platform 2 has its back support 23 comprising a lower back section 4, a middle back section 5 extending therefrom towards the platform's end, and two shoulder sections 6; 6*a*, 6*b*. The back support 23 is affixed by the lower back section 4 to the pelvis support 21 in a manner that allows its pivoting in vertical plane, that is, about a horizontally extending axis. The shoulder sections 6; 6*a*, 6*b* are disposed on either side of the middle back section 5. A patient is placed on the platform 2 in such a way that the patient's lower back rests against the lower back section 4, the patient's head against an end 51 of the middle back section 5 (or, optionally, against a headrest 53 mounted on the middle back section), and the shoulder areas against the shoulder sections 6. The lower back section 4 and the middle back section 5 are preferably coplanar with each other. Consequently, the shoulder sections 6; 6*a*, 6*b* are also coplanar with the lower back section 4 and the middle back section 5. The shoulder sections 6; 6*a*, 6*b* are removably attached to the back support 2; 23, preferably both to the lower back section 4 and to the middle back section 5. The lower back section and middle back section from a non-removable back section contrasted to the removable shoulder section s "non-removable" refers, of course, to the normal use during surgery procedures. The shoulder sections 6; 6*a*, 6*b* are removed once the patient has been placed on the surgical operating table and a surgery on the shoulder region is about to commence. Hence, the shoulder region is provided with space both above and below the surgical operating table's platform 2 for performing the surgical procedure while the patient is stabilized on the surgical operating table.

The shoulder section 6; 6*a*, 6*b* of the back support 23 is an elongated, most preferably substantially rectangular, straight shoulder support. It is clear that the back support's corners can be e.g. rounded. What is essential is that those sides of the shoulder section 6 which abut the middle back section 5 and the lower back section 4 are predominantly straight sides and, in a basic plane B-B of the shoulder support 6, most preferably perpendicular to each other. The contour of other sides is optionally relatively arbitrary, but, in terms of manufacturing engineering, they are most preferably also straight or modified straight sides.

The shoulder section 6; 6*a*, 6*b* is secured removably by means of attachment elements 7, particularly first and second attachment elements 7*a*, 7*b*, to the lower back section 4 of the back support 3.

In an embodiment of the invention, the shoulder section 6; 6*a*, 6*b* is additionally locked releasably by locking device 8 to the middle back section 5.

The shoulder section 6; 6*a*, 6*b* is provided with first attachment elements 7*a*, comprising at least one inclined protrusion 62 and, in association therewith, a slot 63 which is disposed at an end of the shoulder section, such as at a first end 61, and co-directionally with the end. The shoulder section's 6; 6*a*, 6*b* first end 61 is straight. The slot 63 is disposed most preferably at a base of the protrusion 62 on a bottom surface of the shoulder section.

The protrusion 62 connects to the shoulder section 6 by having an outer surface 60 of the shoulder section and an outer surface 622 of the protrusion at an inclined angle relative to each other in a vertical plane C-C. The protrusion 62 is smaller in diameter than the shoulder section. The slot 63 or the like groove is at a base of the protrusion 62 partially embedded in the protrusion.

In an embodiment of the invention, the protrusion 62 is a conical member, which is at an angle relative to a longitudinal direction of the shoulder section and the vertical plane C-C and which tapers towards a tip 621. Thus, the protrusion 62 is at an inclined angle relative to the shoulder section's 6 plane B-B (i.e. a plane perpendicular to the vertical plane C-C). A first or largest diameter h (i.e. a base diameter) of the protrusion 62 in the vertical plane C-C is preferably about half of a diameter k of the shoulder section, particularly its first end 61, and, in horizontal plane, the protrusion is most preferably equal in width to the first end 61 and the shoulder section. Alternatively, there are two protrusions 62 (or even more than that), which are arranged in parallel. The protrusions are fitted on both edges of the end 61 (and/or co-directionally with the end) and have a gap between themselves.

An outer surface 622 of the protrusion 62 merges with and continues directly as an outer surface 60 of the shoulder section 6; 6*a*, 6*b*. The protrusion has its outer surface 622 at an acute angle $\alpha$ relative to the shoulder section's 6 outer surface 60 and the shoulder section's plane B-B.

The shoulder section 6; 6*a*, 6*b* has an internal surface 623 of its protrusion 62 provided at a base of the protrusion 62 with a slot 63 or a groove, which is co-directional with the end 61 and perpendicular to the vertical plane C-C, and which has most preferably a round bottom 631. Thus, the protrusion 62 has its largest diameter h equal to a distance between the slot's 63 bottom 631 and the protrusion's 62 outer surface 622 and at the same time the shoulder section's 6 outer surface 60 as the diameter is regarded perpendicularly to the plane B-B.

The protrusion's 62 diameter decreases first to a first diameter $h_1$ as the viewing angle is turned (e.g. 30-40 degrees) from the perpendicular plane B-B with the slot's center point D as a fulcrum towards the tip 621, and then the diameter increases slightly to a second diameter $h_2$ as the viewing angle is turned more (e.g. 50-60 degrees). Hence, the protrusion's 62 outer surface is eccentric with respect to the slot's center point D1 (and, at the same time, with respect to a longitudinal axis D-D of a rod 72 fitted in the slot 63 in the securing process).

The lower back section 4, included in the back support 3, has its sides 40; 40*a*, 40*b* on either side of the middle back section 5, particularly a base 52 of the middle back section, and directed therefrom towards the sides of the platform 2. The first end 61 of the shoulder sections 6; 6*a*, 6*b* is adapted to abut the lower back section's sides 40; 40*a*, 40*b* whenever the shoulder sections 6 are in attachment with the surgical operating table 1.

The lower back section 4, particularly the lower back section's sides 40; 40*a*, 40*b*, is provided with second attachment elements 7; 7*b*, which, in a preferred embodiment of the invention, comprise a frame portion 71, a rod 72, and a gap 73 therebetween. The frame portion has its rod 72 and gap 73 arranged co-directionally with the lower back section's sides 40; 40*a*, 40*b*. Hence, they are also co-directional with the end 61 and protrusion 62 of the shoulder section 6; 6*a*, 6*b* as the shoulder section 6 is being attached to or is in attachment with the lower back section's side 40; 40*a*, 40*b*.

The second attachment elements 7; 7*b* have their frame portion 71 provided most preferably at least with a straight support plate 711 and two plate type brackets 712, 713 protrusive relative thereto. The straight rod 72 is fitted between the brackets 712, 713 and secured thereto.

The straight rod 72 is most preferably a round rod. Alternatively, the straight rod 72 is round at least over a part of its cross-section, especially over its surface closer to the support plate 71. The rod 72 is fixed between the brackets 712, 713 at a suitable constant distance a from the support plate 711 and to be substantially co-directional therewith. Thus, between the rod 72 and the support plate 711 is left a gap 73. Behind the rod 72 and below the support plate 711 is thereby also left a recess 74. The second attachment elements 7; 7*b* are secured via the support plate 711 of the frame portion 71 to the lower back section 4, especially to its side 40; 40*a*, 40*b*, in this embodiment particularly below the lower back section. The width of the frame portion 71, the distance of the brackets 712, 713 from each other, and the length of the rod 72 are most preferably at least approximately equal to the width of the shoulder section's 6 end 61. The resulting benefit is a stable structure.

The shoulder section 6; 6*a*, 6*b* is attachable in a pivotable and removable manner by means of the first attachment elements 7; 7*a*, i.e. the inclined protrusion 62 and the slot 63, to the lower back section 4 of the back support portion 23, particularly to the second attachment elements 7; 7*b* arranged on the side 40; 40*a*, 40*b* which is closer to the first end 61.

When the shoulder section 6; 6*a*, 6*b* is secured with the attachment elements 7; 7*a*, 7*b* to the lower back section 4, the process is as follows. The protrusion (or protrusions) 62 present at the shoulder section's 6 first end 61 are inserted into the gap 73 between the rod 72 and the support plate 711 and further into the recess 74. During the insertion phase, the shoulder section 6 is at an inclined angle, most preferably at the angle α, i.e. in an inclined position F with respect to the plane of the lower back section 4 and the middle back section 5. Thereby the protrusion 62, particularly by virtue of its conical shape, can be conveniently fitted in a position in which the rod 72 finds the slot 63 in the protrusion's 62 bottom surface and supports itself therein. This is followed by pivoting the shoulder section 6 from the inclined angle to level with the plane of the lower back section 4 and the middle back section 5 with the rod 72 as a pivot axis. Now, the protrusion 62 becomes wedged and clamped between the support plate 711 and the rod 72 and keeps the shoulder panel 6; 6*a*, 6*b* locked to the lower back section's 4 side 40; 40*a*, 40*b*. At the same time, the protrusion's 62 tip portion 621 turns in the recess 74 to a position at least partially behind the rod 72, whereby, it grows in a way, due to its eccentric configuration, to become larger in diameter (cf. diameter $h_2$) than the diameter of the protrusion's groove and the protrusion's base (cf. $h_1$), and it holds the protrusion 62 and thereby the shoulder section 6 securely locked in engagement with the lower back section 4. It should be noted that the distance a of the rod 72 from the support plate 711 is preferably equal to the protrusion's 62 largest diameter h, whereby a reliable attachment is secured whenever the shoulder section has been pivoted to the same plane or the rectilinear position G with the lower back section 4.

Respectively, in the process of removing it, the shoulder section 6; 6*a*, 6*b* is first pivoted to an inclined angle, preferably to the angle α, downward from the plane of the lower back section 4 and the middle back section 5. This enables releasing the protrusion 62 from being pinched by the support plate 711 and the rod 72. The shoulder section 6 remains in this pivoted position by virtue of the attachment elements 7; 7*a*, 7*b* without disengaging and falling. After this, the shoulder section 6; 6*a*, 6*b* can be withdrawn out of the gap 73 and removed from the lower back section 4.

In order to facilitate its manipulation (removal and attachment), the shoulder section 6; 6*a*, 6*b* is provided with a handle 9. Most preferably, it is disposed in the proximity of one end of the shoulder section 6.

In a preferred embodiment of the invention, the second attachment elements 7; 7*b* have their rod 72 provided with a flange 75. The flange 75 is disposed at the rod's end adjacent to the second bracket 713. That outer edge of the flange 75, which is closer to the rod, is provided with a chamfer 751, whereby it is at an inclined angle relative to the rod's 72 longitudinal axis. The flange 75, and particularly its chamfer 751, is adapted to function as a guide means for the protrusion whenever the shoulder section's 6 protrusion (or protrusions) 62 is (are) inserted into the gap 73 between the rod 72 and the support plate 711. The chamfer 751 centers the inserted protrusion 62 to a right position between the first bracket 712 and the flange 75 for a secure attachment.

In a most preferred embodiment of the invention, the shoulder section 6; 6*a*, 6*b* is additionally provided with a locking device 8 for securing the shoulder section releasably to the middle back section 5. The locking device is arranged in connection with a first side 64 of the shoulder section 6; 6*a*, 6*b* and that side 52; 52*a*, 52*b* of the middle back section 5 which is closer to the shoulder section. The first side 64 of the shoulder section 6 is straight and substantially perpendicular to the first end 61. The shoulder section's first side 64 is provided with the locking device 8 at a suitable distance from the first end 61.

The locking device 8 comprises, in a preferred embodiment thereof, a locking member 81, which is substantially perpendicular and movable relative to the shoulder section's first side 64 and which is provided with a loading spring 82. The locking member 81 is most preferably a locking bolt 811, which extends crosswise relative to the vertical plane C-C across the entire shoulder section 6; 6*a*, 6*b*. A first end 812 of the locking member 81; 811 is capable of being fitted in a locking hole 83, which in a locked condition functions as a locking seat and which is arranged in connection with the middle back section's 5 side 52; 52*a* closer to the shoulder section at a location corresponding to the locking member 81 of the shoulder section's first side 64. The locking member 81; 811 is provided with an appropriate lever 84 for operating the locking member. The lever 84 is most preferably located at a second end 813 of the locking member 81; 811 and at the same time on a second side 65 of the shoulder section 6; 6*a*, 6*b* or in the proximity thereof, such as below.

The locking device 8 works as follows. The shoulder section 6; 6*a*, 6*b* is secured with the attachment elements 7; 7*a*, 7*b* to the lower back section 4, as described above. When the shoulder section 6; 6*a*, 6*b* is pivoted from an inclined position to a position coplanar with the lower back section 4 and the middle back section 5, the locking member 81 has been pulled by the lever 84 into the interior of the shoulder section 6; 6*a*, 6*b* against a spring force of the spring 82. When the shoulder section 6; 6*a*, 6*b* is flush with the middle back section 5, i.e. in the straight position G, and the locking member 81; 811 is in alignment with the locking hole 83, the lever 84 is released and the locking member 81; 811 is pushed by the spring 82 into the locking hole 83, whereby the shoulder section 6; 6*a*, 6*b* is locked in place to the middle back section 5, particularly in a position coplanar therewith.

In a preferred embodiment of the locking device 8, the middle back section 5 has its side 64 further provided with a guide seat 85. This guide seat 85 is preferably an inclined surface 851 included in the side 64. The inclined surface is preferably designed as such a straight surface, which, when regarded from below in a pivoting direction of the shoulder section 6 (from below upward to the plane of the middle back section 5), is at an inclined angle relative to the shoulder section's first side 64. The resulting benefit is that the locking member 81; 811, when carrying out the locking operation, slides along the guide seat to the locking hole 83, thus eliminating a need to use the lever 84. An advantage is easy and simple locking in place of the shoulder section 6 whenever the shoulder section 6 is reinstalled in its place in engagement with the surgical operating table 1, especially the lower back section 4 and the middle back section 5.

The invention is not limited to concern just the foregoing exemplary embodiment, but a multitude of modifications are possible while remaining within the inventive concept defined in the claims.

The invention claimed is:

1. A surgical operating table comprising a platform for the patient and an adjustment pedestal portion with the platform rested thereupon, said platform comprising a plurality of sections, which are connected to each other and capable of being pivoted at least in vertical plane, and upon which the patient is rested while a surgical procedure is performed, said sections including a back support, which comprises a lower back section, a middle back section extending therefrom, and two shoulder sections disposed on either side of the middle back section and releasably secured to the lower back section by attachment elements, wherein the attachment elements comprise first and second attachment elements, such that the shoulder section is provided with first attachment elements, which comprise an inclined protrusion and, in engagement therewith, a slot which is disposed at an end of the shoulder section, the lower back section, particularly sides of the lower back section, are provided with second attachment elements comprising a frame portion, a rod, and a gap therebetween, wherein, in a securing process of the shoulder section, the inclined protrusion of the first attachment elements is pushed into the gap while the shoulder section is at an inclined angle relative to the lower back section's plane in such a way that the rod finds the slot of the protrusion and is supported therein, which is followed by pivoting the shoulder section from the inclined angle to a position coplanar with the lower back section and the middle back section with the rod constituting a pivoting axis, whereby the protrusion is wedged and clamped between the frame portion and the rod and maintains the shoulder panel locked to the side of the lower back section, and wherein, in its releasing process, the shoulder section is first pivoted to an inclined angle downward from a plane of the lower back section and the middle back section, thus enabling the protrusion to be released from the clamping of the frame portion and the rod, after which the shoulder section is capable of being pulled out of the gap and removed from the lower back section.

2. A surgical operating table as set forth in claim 1, wherein the protrusion is a conical member, which is at an angle relative to a longitudinal direction and vertical plane of the shoulder section and tapering towards a tip.

3. A surgical operating table as set forth in claim 2, wherein the shoulder section is further provided with a locking device for a removable attachment of the shoulder section to the middle back section, said locking device being arranged in connection with a first side of the shoulder section and that side of the middle back section which is closer to the shoulder section.

4. A surgical operating table as set forth in claim 1, wherein rod of the second attachment elements has its end provided with a flange and the flange has its edge closer to the rod provided with a chamfer, which is adapted to function as a guide means for the protrusion as the shoulder section's protrusion is inserted into the gap in a securing process of the shoulder section.

5. A surgical operating table as set forth in claim 4, wherein the shoulder section is further provided with a locking device for a removable attachment of the shoulder section to the middle back section, said locking device being arranged in connection with a first side of the shoulder section and that side of the middle back section which is closer to the shoulder section.

6. A surgical operating table as set forth in claim 1, wherein the shoulder section is further provided with a locking device for a removable attachment of the shoulder section to the middle back section, said locking device being arranged in connection with a first side of the shoulder section and that side of the middle back section which is closer to the shoulder section.

7. A surgical operating table as set forth in claim 6, wherein the locking device comprises a locking member, preferably a locking bolt, which is substantially perpendicular and movable relative to the shoulder section's first side and which is provided with a loading spring, and a first end of the locking member is capable of being fitted in a locking hole, which in a locked condition functions as a locking seat and which is arranged in connection with the middle back section's side closer to the shoulder section at a location corresponding to the locking member of the shoulder section's first side.

8. A surgical operating table as set forth in claim 7, wherein the locking device includes a guide seat, which is preferably an inclined surface and included in the middle back section's side.

9. A surgical operating table, said surgical table comprising a platform for the patient and an adjustment pedestal portion supporting the platform, said platform comprising a plurality of sections including a back support, said back support comprising a lower back section, a middle back section extending from the lower back section, said back support also comprising two shoulder sections positioned on two sides of the middle back section, each shoulder section releasably attachable to the lower back section by way of cooperating attachment elements, one attached to a lower portion of the shoulder piece and one attached to the lower back section, one of the cooperating attachment elements comprising a slotted bracket and the other of the cooperating attachment elements comprising an insertion member to be received in the slotted bracket; each shoulder section further having a pair of cooperating locking portions for releasably securing the top portion of each respective shoulder section to the middle back section, each respective locking portions having a locked position and an unlocked position;

wherein the cooperative attachment elements provide a partial rotation of each of the respective shoulder sections in a direction away from a patient on the operating table when the respective locking portions are in the unlocked position, and wherein the cooperating attachment elements are configured for allowing disconnection of the cooperating attachment elements only when the shoulder section has been partially rotated away from the patient on the operating table.

10. The surgical operating table of claim 9 wherein the slotted bracket is on positioned on the shoulder sections and the cooperating insertion member is positioned on the lower back section.

11. A surgical operating table, which is intended for shoulder operations or surgical procedures performed on a similar part of the body, said surgical table comprising a platform for the patient and an adjustment pedestal portion supporting the platform, said platform comprising a plurality of sections including a back support, said back support comprising a non removable back section and two shoulder sections positioned at two upper corners of the back section, each shoulder section releasably attachable to the non removable back section by way of cooperating attachment elements, one attached to the shoulder piece and one attached to the non removing back section, one of the cooperating attachment elements comprising a slotted bracket and the other of the cooperating attachment elements comprising an insertion member to be received in the slotted bracket, each shoulder section having a pair of cooperating locking portions for reliably securing a top portion of each respective shoulder section to the non removable back section, each respective locking portions having a locked and an unlocked position, wherein the cooperative attachment elements provide a partial rotation of each of the respective shoulder sections in a direction away from a patient on the operating table when the respective locking portions are in the unlocked position, and wherein the cooperating attachment elements are configured for allowing disconnection of the cooperating attachment elements only when the shoulder section has been partially rotated away from the patient on the operating table.

* * * * *